US012378678B2

(12) United States Patent
Dawson et al.

(10) Patent No.: US 12,378,678 B2
(45) Date of Patent: Aug. 5, 2025

(54) INTEGRATED HYDROGEN PRODUCTION METHOD AND SYSTEM

(71) Applicant: Utility Global, Inc., Houston, TX (US)

(72) Inventors: Matthew Dawson, Katy, TX (US); Nicholas Farandos, Bray (IE); Jin Dawson, Katy, TX (US)

(73) Assignee: Utility Global, Inc., Houston, TX (US)

( * ) Notice: Subject to any disclaimer, the term of this patent is extended or adjusted under 35 U.S.C. 154(b) by 448 days.

(21) Appl. No.: 17/856,220

(22) Filed: Jul. 1, 2022

(65) Prior Publication Data

US 2023/0013911 A1 Jan. 19, 2023

Related U.S. Application Data

(60) Provisional application No. 63/219,658, filed on Jul. 8, 2021.

(51) Int. Cl.

| | |
|---|---|
| ***C25B 1/04*** | (2021.01) |
| ***C25B 1/042*** | (2021.01) |
| ***C25B 9/015*** | (2021.01) |
| ***C25B 9/23*** | (2021.01) |
| ***C25B 11/047*** | (2021.01) |
| ***C25B 13/07*** | (2021.01) |

(52) U.S. Cl.

CPC ..... *C25B 1/04* (2013.01); *C25B 9/015* (2021.01); *C25B 9/23* (2021.01); *C25B 11/047* (2021.01); *C25B 13/07* (2021.01); *C25B 1/042* (2021.01)

(58) Field of Classification Search

CPC ..... C25B 1/04–042; H01M 8/00–2495

See application file for complete search history.

(56) References Cited

U.S. PATENT DOCUMENTS

2004/0040862 A1 3/2004 Kosek et al.
2007/0248503 A1 10/2007 Boersma et al.

(Continued)

FOREIGN PATENT DOCUMENTS

WO WO-2020217742 A1 * 10/2020 ..... C25B 1/02

OTHER PUBLICATIONS

Deibert et al., Ion-conducting ceramic membrane reactors for high-temperature applications, 543 J. of Membrane Science 79 (Year: 2017).*

(Continued)

*Primary Examiner* — Hosung Chung

(74) *Attorney, Agent, or Firm* — Foley & Lardner LLP

(57) ABSTRACT

Herein discussed is a hydrogen production system comprising a first reactor zone and a second reactor zone, wherein both reactor zones comprise an ionically conducting membrane, wherein the first zone is capable of reforming a hydrocarbon electrochemically and the second zone is capable of performing water gas shift reactions electrochemically, wherein the electrochemical reforming reactions involve the exchange of an ion through the membrane to oxidize the hydrocarbon and wherein electrochemical water gas shift reactions involve the exchange of an ion through the membrane and include forward water gas shift reactions, or reverse water gas shift reactions, or both. In an embodiment, the membrane is mixed conducting. In an embodiment, the membrane comprises an electronically conducting phase and an ionically conducting phase.

12 Claims, 5 Drawing Sheets

(56) References Cited

U.S. PATENT DOCUMENTS

| | | | | |
|---|---|---|---|---|
| 2010/0314235 | A1* | 12/2010 | Varadaraj | C01B 3/384 201/37 |
| 2017/0216806 | A1* | 8/2017 | Ryi | C01B 3/384 |
| 2019/0006690 | A1* | 1/2019 | Louis | C25B 1/04 |
| 2019/0177861 | A1 | 6/2019 | Ding et al. | |
| 2020/0140297 | A1 | 5/2020 | Hall et al. | |
| 2020/0144627 | A1 | 5/2020 | Hall et al. | |
| 2020/0144628 | A1 | 5/2020 | Hall et al. | |
| 2020/0144633 | A1 | 5/2020 | Hall et al. | |
| 2020/0144635 | A1 | 5/2020 | Hall et al. | |
| 2020/0144646 | A1 | 5/2020 | Hall et al. | |
| 2020/0144647 | A1 | 5/2020 | Hall et al. | |
| 2020/0144648 | A1 | 5/2020 | Hall et al. | |
| 2020/0144653 | A1 | 5/2020 | Hall et al. | |
| 2020/0144654 | A1 | 5/2020 | Hall et al. | |
| 2020/0156104 | A1 | 5/2020 | Hall et al. | |
| 2020/0176803 | A1 | 6/2020 | Hall et al. | |
| 2020/0182549 | A1 | 6/2020 | Hall et al. | |
| 2020/0227763 | A1 | 7/2020 | Hall et al. | |
| 2020/0235409 | A1 | 7/2020 | Hall et al. | |
| 2020/0235410 | A1 | 7/2020 | Hall et al. | |
| 2020/0255959 | A1 | 8/2020 | Hall et al. | |
| 2020/0255962 | A1 | 8/2020 | Hall et al. | |
| 2020/0255963 | A1 | 8/2020 | Dawson et al. | |
| 2020/0259186 | A1 | 8/2020 | Hall et al. | |
| 2020/0303749 | A1 | 9/2020 | Hall et al. | |
| 2021/0024425 | A1 | 1/2021 | Dawson et al. | |
| 2021/0069786 | A1 | 3/2021 | Hall et al. | |
| 2021/0121978 | A1 | 4/2021 | Dawson et al. | |
| 2021/0175531 | A1 | 6/2021 | Farandos et al. | |
| 2021/0399325 | A1* | 12/2021 | Onuma | H01M 4/8605 |
| 2022/0364245 | A1 | 11/2022 | Farandos et al. | |
| 2022/0364251 | A1 | 11/2022 | Dawson et al. | |
| 2022/0372635 | A1 | 11/2022 | Farandos et al. | |
| 2022/0380210 | A1 | 12/2022 | Farandos et al. | |
| 2022/0403532 | A1 | 12/2022 | Farandos et al. | |
| 2023/0002915 | A1 | 1/2023 | Dawson et al. | |
| 2023/0020427 | A1 | 1/2023 | Farandos et al. | |
| 2023/0092683 | A1 | 3/2023 | Farandos et al. | |
| 2023/0109683 | A1 | 4/2023 | Dawson et al. | |
| 2023/0167560 | A1 | 6/2023 | Dawson et al. | |
| 2023/0175143 | A1 | 6/2023 | Farandos et al. | |
| 2024/0133052 | A1 | 4/2024 | Matthews et al. | |
| 2024/0133062 | A1 | 4/2024 | Dawson et al. | |
| 2024/0167169 | A1 | 5/2024 | Dawson et al. | |
| 2024/0200210 | A1 | 6/2024 | Dawson | |
| 2024/0209530 | A1 | 6/2024 | Dawson et al. | |
| 2024/0287688 | A1 | 8/2024 | Dawson et al. | |
| 2024/0287689 | A1 | 8/2024 | Dawson et al. | |

OTHER PUBLICATIONS

Peschel et al., Original and Machine Translation, WO-2019206450-A1 (Year: 2019).*

Dai, X. P. et al. The Journal of Physical Chemistry B, "Hydrogen Production from a Combination of the Water-Gas Shift and Redox Cycle Process of Methane Partial Oxidation via Lattice Oxygen over LaFeO3 Perovskite Catalyst," Dec. 2006, vol. 110, pp. 25856-25862 see pp. 25857-25858; figure 2.

Deibert, W. et al. Journal of Membrane Science, "Ion-conducting ceramic membrane reactors for high temperature applications," 2017, vol. 543, pp. 79-97 pp. 83-86; tables 1, 4-6, 8.

International Search Report and Written Opinion issued for PCT/US2022/035934 on Nov. 1, 2022, 10 pages.

* cited by examiner

INTEGRATED HYDROGEN PRODUCTION METHOD AND SYSTEM

CROSS-REFERENCE TO RELATED APPLICATIONS

This application claims the benefit under 35 U.S.C. 119(e) of U.S. Provisional Patent Application No. 63/219,658 filed Jul. 8, 2021, the entire disclosure of which is hereby incorporated herein by reference.

TECHNICAL FIELD

This invention generally relates to hydrogen production. More specifically, this invention relates to an electrochemical hydrogen production method and system.

BACKGROUND

Hydrogen in large quantities is needed in the petroleum and chemical industries. For example, large amounts of hydrogen are used in upgrading fossil fuels and in the production of ammonia or methanol or hydrochloric acid. Petrochemical plants need hydrogen for hydrocracking, hydrodesulfurization, hydrodealkylation. Hydrogenation processes to increase the level of saturation of unsaturated fats and oils also need hydrogen. Hydrogen is also a reducing agent of metallic ores. Hydrogen may be produced from electrolysis of water, steam reforming, lab-scale metal-acid process, thermochemical methods, or anaerobic corrosion. Many countries are aiming at a hydrogen economy.

Clearly there is increasing need and interest to develop new technological platforms to produce hydrogen. This disclosure discusses hydrogen production using efficient electrochemical pathways. The electrochemical reactor and the method to perform such reactions are discussed.

SUMMARY

Herein discussed is a hydrogen production system comprising a first reactor zone and a second reactor zone, wherein both reactor zones comprise an ionically conducting membrane, wherein the first zone is capable of reforming a hydrocarbon electrochemically and the second zone is capable of performing water gas shift reactions electrochemically, wherein the electrochemical reforming reactions involve the exchange of an ion through the membrane to oxidize the hydrocarbon and wherein electrochemical water gas shift reactions involve the exchange of an ion through the membrane and include forward water gas shift reactions, or reverse water gas shift reactions, or both. In an embodiment, the membrane is mixed conducting. In an embodiment, the membrane comprises an electronically conducting phase and an ionically conducting phase.

In an embodiment, the electrochemical reforming reactions comprise electrochemical half-cell reactions, wherein the half-cell reactions are:

$$CH_4+O_2 \rightleftharpoons CO+2H_2+2e^- \quad a)$$

$$H_2O+2e^- \rightleftharpoons H_2+O^{2-} \quad b)$$

In an embodiment, the electrochemical water gas shift reactions comprise electrochemical half-cell reactions, wherein the half-cell reactions are:

$$CO_{(gas)}+O^{2-} \rightleftharpoons CO_{2(gas)}+2e^- \quad a)$$

$$H_2O_{(gas)}+2e^- \rightleftharpoons H_{2(gas)}+O^{2-} \quad b)$$

In an embodiment, the half-cell reactions take place at triple phase boundaries, wherein the triple phase boundaries are the intersections of pores with the electronically conducting phase and the ionically conducting phase.

In an embodiment, both reactor zones comprise porous electrodes that comprise metallic phase and ceramic phase, wherein the metallic phase is electronically conductive, and wherein the ceramic phase is ionically conductive. In an embodiment, the electrodes have no current collector attached. In an embodiment, the electrodes are separated by the membrane and are both exposed to a reducing environment.

In an embodiment, the electrodes in the second reactor zone comprise Ni or NiO and a material selected from the group consisting of YSZ, 8YSZ, CGO, CoCGO, SDC, SSZ, LSGM, and combinations thereof. In an embodiment, one of the electrodes in the first reactor zone comprises Ni or NiO and a material selected from the group consisting of YSZ, 8YSZ, CGO, CoCGO, SDC, SSZ, LSGM, and combinations thereof, and wherein the other of the electrodes comprises doped or undoped ceria and a material selected from the group consisting of Cu, CuO, $Cu_2O$, Ag, $Ag_2O$, Au, $Au_2O$, $Au_2O_3$, Pt, Pd, Ru, Rh, Ir, LaCaCr, LaSrCrFe, YSZ, CGO, SDC, SSZ, LSGM, stainless steel, and combinations thereof. In an embodiment, one of the electrodes in the first reactor zone comprises Ni or NiO and a material selected from the group consisting of YSZ, 8YSZ, CGO, CoCGO, SDC, SSZ, LSGM, and combinations thereof, and wherein the other of the electrodes comprises lanthanum chromite and a material selected from the group consisting of doped ceria, yttria-stabilized zirconia (YSZ), lanthanum strontium gallate magnesite (LSGM), scandia-stabilized zirconia (SSZ), Sc and Ce doped zirconia, and combinations thereof. In an embodiment, the lanthanum chromite comprises undoped lanthanum chromite, strontium doped lanthanum chromite, iron doped lanthanum chromite, strontium and iron doped lanthanum chromite, lanthanum calcium chromite, or combinations thereof.

In an embodiment, the ionically conducting membrane conducts protons or oxide ions. In an embodiment, the ionically conducting membrane is impermeable to fluid flow. In an embodiment, the membrane comprises an electronically conducting phase containing doped lanthanum chromite or an electronically conductive metal or combination thereof; and wherein the membrane comprises an ionically conducting phase containing a material selected from the group consisting of gadolinium doped ceria (CGO), samarium doped ceria (SDC), yttria-stabilized zirconia (YSZ), lanthanum strontium gallate magnesite (LSGM), scandia-stabilized zirconia (SSZ), Sc and Ce doped zirconia, and combinations thereof. In an embodiment, the doped lanthanum chromite comprises strontium doped lanthanum chromite, iron doped lanthanum chromite, strontium and iron doped lanthanum chromite, lanthanum calcium chromite, or combinations thereof and wherein the conductive metal comprises Ni, Cu, Ag, Au, Pt, Rh, Co, Ru, or combinations thereof. In an embodiment, the membrane comprises gadolinium doped ceria (CGO) or samarium doped ceria (SDC) or both. In an embodiment, the membrane consists of gadolinium doped ceria (CGO) or samarium doped ceria (SDC) or both. In an embodiment, the membrane comprises CoCGO or LST (lanthanum-doped strontium titanate)-stabilized zirconia. In an embodiment, the stabilized zirconia comprises YSZ or SSZ or SCZ (scandia-ceria-stabilized zirconia).

In an embodiment, the ionically conducting membrane also conducts electrons and wherein the system comprises no interconnect. In an embodiment, the first reactor zone and the second reactor zone are in fluid communication on two sides of the membrane respectively but not across the membrane. In an embodiment, the hydrocarbon passes through the first reactor zone prior to passing through the second reactor zone.

In an embodiment, the first reactor zone and the second reactor zone are on a single reactor tube. In an embodiment, the first reactor zone and the second reactor zone are on the same reactor tube or tubes. In an embodiment, the reactor tube has an open end and an opposite closed end. In an embodiment, the first reactor zone and the second reactor zone are on different reactor tubes. In an embodiment, the first reactor zone or the second reactor zone comprises multiple reactor tubes.

Also discussed herein is a method of producing hydrogen comprising providing a hydrogen production system comprising a first reactor zone and a second reactor zone, wherein both reactor zones comprise a mixed-conducting membrane, introducing a first stream comprising a hydrocarbon to the system, introducing a second stream comprising water to the system, and reducing the water in the second stream to produce hydrogen, wherein the first stream and the second stream do not come in contact with each other in the system, and wherein the hydrocarbon is reformed electrochemically in the first reactor zone.

In an embodiment, electrochemical water gas shift reactions take place in the second reactor zone. In an embodiment, reduction from water to hydrogen takes place electrochemically. In an embodiment, the first stream and the second stream are separated by the membrane. In an embodiment, the second stream comprises hydrogen. In an embodiment, the first stream consists essentially of a hydrocarbon and hydrogen. In an embodiment, both reactor zones comprise an anode on the first stream side and a cathode on the second stream side, wherein the anode and the cathode are separated by the membrane and are in contact with the membrane respectively. In an embodiment, the anode and the cathode are both exposed to a reducing environment.

In an embodiment, the anode and the cathode in the second reactor zone comprise Ni or NiO and a material selected from the group consisting of YSZ, 8YSZ, CGO, CoCGO, SDC, SSZ, LSGM, and combinations thereof. In an embodiment, the anode in the first reactor zone comprises doped or undoped ceria and a material selected from the group consisting of Cu, CuO, $Cu_2O$, Ag, $Ag_2O$, Au, $Au_2O$, $Au_2O_3$, Pt, Pd, Ru, Rh, Ir, LaCaCr, LaSrCrFe, YSZ, CGO, SDC, SSZ, LSGM, stainless steel, and combinations thereof; and wherein the cathode in the first reactor zone comprises Ni or NiO and a material selected from the group consisting of YSZ, 8YSZ, CGO, CoCGO, SDC, SSZ, LSGM, and combinations thereof. In an embodiment, the anode in the first reactor zone comprises lanthanum chromite and a material selected from the group consisting of doped ceria, yttria-stabilized zirconia (YSZ), lanthanum strontium gallate magnesite (LSGM), scandia-stabilized zirconia (SSZ), Sc and Ce doped zirconia, and combinations thereof; wherein the cathode in the first reactor zone comprises Ni or NiO and a material selected from the group consisting of YSZ, 8YSZ, CGO, CoCGO, SDC, SSZ, LSGM, and combinations thereof. In an embodiment, the lanthanum chromite comprises undoped lanthanum chromite, strontium doped lanthanum chromite, iron doped lanthanum chromite, strontium and iron doped lanthanum chromite, lanthanum calcium chromite, or combinations thereof.

In an embodiment, the method comprises recycling at least portion of the produced hydrogen to the first stream or the second stream or both. In an embodiment, the system comprises no interconnect. In an embodiment, the system does not generate electricity and does not need electricity input for the reactor zones to operate. In an embodiment, the first stream passes through the first reactor zone prior to passing through the second reactor zone.

In an embodiment, the first reactor zone and the second reactor zone are on a single reactor tube. In an embodiment, the first reactor zone and the second reactor zone are on the same reactor tube or tubes. In an embodiment, the reactor tube has an open end and an opposite closed end. In an embodiment, the first reactor zone or the second reactor zone comprises multiple reactor tubes. In an embodiment, the reactor tubes each have an open end and an opposite closed end. In an embodiment, the first reactor zone and the second reactor zone are on different reactor tubes.

Further aspects and embodiments are provided in the following drawings, detailed description, and claims. Unless specified otherwise, the features as described herein are combinable and all such combinations are within the scope of this disclosure.

BRIEF DESCRIPTION OF THE DRAWINGS

The following drawings are provided to illustrate certain embodiments described herein. The drawings are merely illustrative and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

Overview

Figure 1:
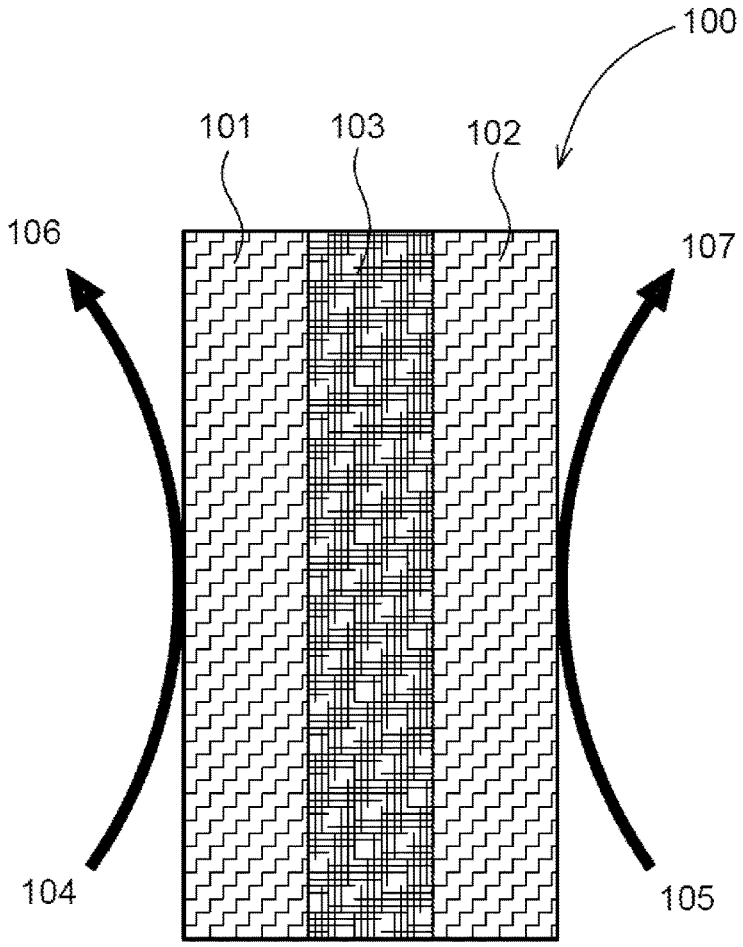
FIG. 1 illustrates an electrochemical (EC) reactor or an electrochemical gas producer, according to an embodiment of this disclosure.

The disclosure herein describes an electrochemical hydrogen production method and system. The method and system of this disclosure produce hydrogen via electrochemical reforming and electrochemical water gas shift (WGS) reactions. The oxygen/oxide needed for such reforming and WGS reactions derives from the reduction of water, and it is supplied across a membrane.

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like. As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

As used herein, compositions and materials are used interchangeably unless otherwise specified. Each composition/material may have multiple elements, phases, and components. Heating as used herein refers to actively adding energy to the compositions or materials.

As used herein, YSZ refers to yttria-stabilized zirconia; SDC refers to samaria-doped ceria; SSZ refers to scandia-stabilized zirconia; LSGM refers to lanthanum strontium gallate magnesite.

In this disclosure, no substantial amount of $H_2$ means that the volume content of the hydrogen is no greater than 5%, or no greater than 3%, or no greater than 2%, or no greater than 1%, or no greater than 0.5%, or no greater than 0.1%, or no greater than 0.05%.

As used herein, CGO refers to Gadolinium-Doped Ceria, also known alternatively as gadolinia-doped ceria, gadolinium-doped cerium oxide, cerium(IV) oxide, gadolinium-doped, GDC, or GCO, (formula Gd:$CeO_2$). CGO and GDC are used interchangeably unless otherwise specified. Syngas (i.e., synthesis gas) in this disclosure refers to a mixture consisting primarily of hydrogen, carbon monoxide and carbon dioxide.

A mixed conducting membrane is able to transport both electrons and ions. Ionic conductivity includes ionic species such as oxygen ions (or oxide ions), protons, halogenide anions, chalcogenide anions. In various embodiment, the mixed conducting membrane of this disclosure comprises an electronically conducting phase and an ionically conducting phase.

In this disclosure, the axial cross section of the tubulars is shown to be circular, which is illustrative only and not limiting. The axial cross section of the tubulars is any suitable shape as known to one skilled in the art, such as square, square with rounded corners, rectangle, rectangle with rounded corners, triangle, hexagon, pentagon, oval, irregular shape, etc.

As used herein, ceria refers to cerium oxide, also known as ceric oxide, ceric dioxide, or cerium dioxide, is an oxide of the rare-earth metal cerium. Doped ceria refers to ceria doped with other elements, such as samaria-doped ceria (SDC), or gadolinium-doped ceria (GDC or CGO). As used herein, chromite refers to chromium oxides, which includes all the oxidation states of chromium oxides.

A layer or substance being impermeable as used herein refers to it being impermeable to fluid flow. For example, an impermeable layer or substance has a permeability of less than 1 micro darcy, or less than 1 nano darcy.

In this disclosure, sintering refers to a process to form a solid mass of material by heat or pressure, or a combination thereof, without melting the material to the extent of liquefaction. For example, material particles are coalesced into a solid or porous mass by being heated, wherein atoms in the material particles diffuse across the boundaries of the particles, causing the particles to fuse together and form one solid piece.

Electrochemistry is the branch of physical chemistry concerned with the relationship between electrical potential, as a measurable and quantitative phenomenon, and identifiable chemical change, with either electrical potential as an outcome of a particular chemical change, or vice versa. These reactions involve electrons moving between electrodes via an electronically-conducting phase (typically, but not necessarily, an external electrical circuit), separated by an ionically-conducting and electronically insulating membrane (or ionic species in a solution). When a chemical reaction is effected by a potential difference, as in electrolysis, or if electrical potential results from a chemical reaction as in a battery or fuel cell, it is called an electrochemical reaction. Unlike chemical reactions, in electrochemical reactions electrons (and necessarily resulting ions), are not transferred directly between molecules, but via the aforementioned electronically conducting and ionically conducting circuits, respectively. This phenomenon is what distinguishes an electrochemical reaction from a chemical reaction.

Related to the electrochemical water gas shift (WGS) reactor and methods of use, various components of the reactor are described such as electrodes and membranes along with materials of construction of the components. The following description recites various aspects and embodiments of the inventions disclosed herein. No particular embodiment is intended to define the scope of the invention. Rather, the embodiments provide non-limiting examples of various compositions and methods that are included within the scope of the claimed inventions. The description is to be read from the perspective of one of ordinary skill in the art. Therefore, information that is well-known to the ordinarily skilled artisan is not necessarily included.

Electrochemical Reactor

Contrary to conventional practice, an electrochemical reactor has been discovered, which comprises an ionically conducting membrane, wherein the reactor is capable of performing the water gas shift reactions electrochemically, wherein electrochemical water gas shift reactions involve the exchange of an ion through the membrane and include forward water gas shift reactions, or reverse water gas shift reactions, or both. This is different from water gas shift reactions via chemical pathways because chemical water gas shift reactions involve direct combination of reactants.

In an embodiment, the reactor comprises porous electrodes that comprise metallic phase and ceramic phase, wherein the metallic phase is electronically conductive and wherein the ceramic phase is ionically conductive. In various embodiments, the electrodes have no current collector attached to them. In various embodiments, the reactor does not contain any current collector. Clearly, such a reactor is fundamentally different from any electrolysis device or fuel cell.

In an embodiment, one of the electrodes in the reactor is an anode that is configured to be exposed to a reducing environment while performing oxidation reactions electrochemically. In various embodiments, the electrodes comprise Ni or NiO and a material selected from the group consisting of YSZ, 8YSZ, CGO, CoCGO, SDC, SSZ, LSGM, and combinations thereof.

The electrochemical water gas shift reactions taking place in the reactor comprise electrochemical half-cell reactions, wherein the half-cell reactions are:

$$CO_{(gas)}+O^{2-} \rightleftharpoons CO_{2(gas)}+2e^{-} \quad a)$$

$$H_2O_{(gas)}+2e^{-} \rightleftharpoons H_{2(gas)}+O^{2-} \quad b)$$

In various embodiments, the half-cell reactions take place at triple phase boundaries, wherein the triple phase boundaries are the intersections of pores with the electronically conducting phase and the ionically conducting phase. Furthermore, the reactor is also capable of performing chemical water gas shift reactions.

In various embodiments, the ionically conducting membrane conducts protons or oxide ions. In various embodiments, the ionically conducting membrane comprises solid oxide. In various embodiments, the ionically conducting membrane is impermeable to fluid flow. In various embodiments, the ionically conducting membrane also conducts electrons and wherein the reactor comprises no interconnect.

In an embodiment, the membrane comprises an electronically conducting phase containing doped lanthanum chromite or an electronically conductive metal or combination thereof; and wherein the membrane comprises an ionically conducting phase containing a material selected from the group consisting of gadolinium doped ceria (CGO), samarium doped ceria (SDC), yttria-stabilized zirconia (YSZ), lanthanum strontium gallate magnesite (LSGM), scandia-stabilized zirconia (SSZ), Sc and Ce doped zirconia, and combinations thereof. In an embodiment, the doped lanthanum chromite comprises strontium doped lanthanum chromite, iron doped lanthanum chromite, strontium and iron doped lanthanum chromite, lanthanum calcium chromite, or combinations thereof; and wherein the conductive metal comprises Ni, Cu, Ag, Au, Pt, Rh, Co, Ru, or combinations thereof.

Also discussed herein is a reactor comprising a bi-functional layer and a mixed conducting membrane; wherein the bi-functional layer and the mixed conducting membrane are in contact with each other, and wherein the bi-functional layer catalyzes reverse-water-gas-shift (RWGS) reaction and functions as an anode in an electrochemical reaction. In an embodiment, the bi-functional layer as the anode is exposed to a reducing environment and the electrochemical reaction taking place in the bi-functional layer is oxidation. In an embodiment, no current collector is attached to the bi-functional layer. In an embodiment, the bi-functional layer comprises Ni or NiO and a material selected from the group consisting of YSZ, 8YSZ, CGO, CoCGO, SDC, SSZ, LSGM, and combinations thereof.

In an embodiment, the membrane comprises an electronically conducting phase containing doped lanthanum chromite or an electronically conductive metal or combination thereof; and wherein the membrane comprises an ionically conducting phase containing a material selected from the group consisting of gadolinium doped ceria (CGO), samarium doped ceria (SDC), yttria-stabilized zirconia (YSZ), lanthanum strontium gallate magnesite (LSGM), scandia-stabilized zirconia (SSZ), Sc and Ce doped zirconia, and combinations thereof. In an embodiment, the doped lanthanum chromite comprises strontium doped lanthanum chromite, iron doped lanthanum chromite, strontium and iron doped lanthanum chromite, lanthanum calcium chromite, or combinations thereof; and wherein the conductive metal comprises Ni, Cu, Ag, Au, Pt, Rh, Co, Ru, or combinations thereof.

Such a reactor has various applications. In an embodiment, the reactor is utilized to produce carbon monoxide via hydrogenation of carbon dioxide. In another embodiment, the reactor is used to adjust syngas composition (i.e., $H_2$/CO ratio) by converting Hz to CO or converting CO to Hz. The following discussion takes hydrogen production as an example, but the application of the reactor is not limited to only hydrogen production.

Herein discussed is an electrochemical reactor comprising an ionically conducting membrane, wherein the reactor is capable of reforming a hydrocarbon electrochemically, wherein the electrochemical reforming reactions involve the exchange of an ion through the membrane to oxidize the hydrocarbon. In an embodiment, the reactor comprises porous electrodes that comprise metallic phase and ceramic phase, wherein the metallic phase is electronically conductive, and wherein the ceramic phase is ionically conductive. In an embodiment, the electrodes have no current collector attached. In an embodiment, the electrodes are separated by the membrane and are both exposed to a reducing environment.

In an embodiment, one of the electrodes comprises Ni or NiO and a material selected from the group consisting of YSZ, 8YSZ, CGO, CoCGO, SDC, SSZ, LSGM, and combinations thereof, and wherein the other of the electrodes comprises doped or undoped ceria and a material selected from the group consisting of Cu, CuO, $Cu_2O$, Ag, $Ag_2O$, Au, $Au_2O$, $Au_2O_3$, Pt, Pd, Ru, Rh, Ir, LaCaCr, LaSrCrFe, YSZ, CGO, SDC, SSZ, LSGM, stainless steel, and combinations thereof. In an embodiment, the other of the electrodes comprises lanthanum chromite and a material selected from the group consisting of doped ceria, yttria-stabilized zirconia (YSZ), lanthanum strontium gallate magnesite (LSGM), scandia-stabilized zirconia (SSZ), Sc and Ce doped zirconia, and combinations thereof. In an embodiment, the lanthanum chromite comprises undoped lanthanum chromite, strontium doped lanthanum chromite, iron doped lanthanum chromite, strontium and iron doped lanthanum chromite, lanthanum calcium chromite, or combinations thereof.

In an embodiment, the electrochemical reforming reactions comprise electrochemical half-cell reactions, wherein the half-cell reactions are:

$$CH_4+O_2 \rightleftharpoons CO+2H_2+2e^{-} \quad a)$$

$$H_2O+2e^{-} \rightleftharpoons H_2+O^{2-} \quad b)$$

In an embodiment, the half-cell reactions take place at triple phase boundaries, wherein the triple phase boundaries are the intersections of pores with the electronically conducting phase and the ionically conducting phase. In an embodiment, the ionically conducting membrane conducts protons or oxide ions. In an embodiment, the ionically conducting membrane is impermeable to fluid flow. In an embodiment, the membrane comprises an electronically conducting phase containing doped lanthanum chromite or an electronically conductive metal or combination thereof; and wherein the membrane comprises an ionically conducting phase containing a material selected from the group consisting of gadolinium doped ceria (CGO), samarium doped ceria (SDC), yttria-stabilized zirconia (YSZ), lanthanum strontium gallate magnesite (LSGM), scandia-stabilized zirconia (SSZ), Sc and Ce doped zirconia, and combinations thereof. In an embodiment, the doped lanthanum chromite comprises strontium doped lanthanum chromite, iron doped lanthanum chromite, strontium and iron doped lanthanum chromite, lanthanum calcium chromite, or combinations thereof; and wherein the conductive metal comprises Ni, Cu, Ag, Au, Pt, Rh, Co, Ru, or combinations thereof.

In an embodiment, the membrane comprises gadolinium doped ceria (CGO) or samarium doped ceria (SDC) or both.

In an embodiment, the membrane consists of gadolinium doped ceria (CGO) or samarium doped ceria (SDC) or both. In an embodiment, the ionically conducting membrane also conducts electrons and wherein the reactor comprises no interconnect.

Further discussed herein is a reactor comprising: an anode and a mixed conducting membrane; wherein the anode and the mixed conducting membrane are in contact with each other, and wherein the anode promotes electrochemical hydrocarbon reforming reactions. In an embodiment, the anode is exposed to a reducing environment and the electrochemical reaction taking place in anode is oxidation. In an embodiment, no current collector is attached to the anode. In an embodiment, the reactor has no interconnect.

In an embodiment, the membrane comprises an electronically conducting phase containing doped lanthanum chromite or an electronically conductive metal or combination thereof and wherein the membrane comprises an ionically conducting phase containing a material selected from the group consisting of gadolinium doped ceria (CGO), samarium doped ceria (SDC), yttria-stabilized zirconia (YSZ), lanthanum strontium gallate magnesite (LSGM), scandia-stabilized zirconia (SSZ), Sc and Ce doped zirconia, and combinations thereof. In an embodiment, the doped lanthanum chromite comprises strontium doped lanthanum chromite, iron doped lanthanum chromite, strontium and iron doped lanthanum chromite, lanthanum calcium chromite, or combinations thereof; and wherein the conductive metal comprises Ni, Cu, Ag, Au, Pt, Rh, Co, Ru, or combinations thereof. In an embodiment, the membrane comprises gadolinium doped ceria (CGO) or samarium doped ceria (SDC) or both. In an embodiment, the membrane consists of gadolinium doped ceria (CGO) or samarium doped ceria (SDC) or both.

In an embodiment, the anode comprises doped or undoped ceria and a material selected from the group consisting of Cu, CuO, $Cu_2O$, Ag, $Ag_2O$, Au, $Au_2O$, $Au_2O_3$, Pt, Pd, Ru, Rh, Ir, LaCaCr, LaSrCrFe, YSZ, CGO, SDC, SSZ, LSGM, stainless steel, and combinations thereof. In an embodiment, the anode comprises lanthanum chromite and a material selected from the group consisting of doped ceria, yttria-stabilized zirconia (YSZ), lanthanum strontium gallate magnesite (LSGM), scandia-stabilized zirconia (SSZ), Sc and Ce doped zirconia, and combinations thereof. In an embodiment, the lanthanum chromite comprises undoped lanthanum chromite, strontium doped lanthanum chromite, iron doped lanthanum chromite, strontium and iron doped lanthanum chromite, lanthanum calcium chromite, or combinations thereof.

Also discussed herein is a method of producing hydrogen comprising providing an electrochemical (EC) reactor having a mixed-conducting membrane, introducing a first stream comprising a hydrocarbon to the reactor, introducing a second stream comprising water to the reactor, and reducing the water in the second stream to produce hydrogen, wherein the first stream and the second stream do not come in contact with each other in the reactor, and wherein the hydrocarbon is reformed electrochemically in the EC reactor. In an embodiment, the method comprises recycling at least portion of the produced hydrogen to the first stream or the second stream or both.

In an embodiment, the reduction from water to hydrogen takes place electrochemically. In an embodiment, water in the second stream is steam. In an embodiment, the first stream and the second stream are separated by the membrane. In an embodiment, the second stream comprises hydrogen. In an embodiment, the first stream consists essentially of a hydrocarbon and hydrogen.

In an embodiment, the EC reactor comprises an anode on the first stream side and a cathode on the second stream side, wherein the anode and the cathode are separated by the membrane and are in contact with the membrane respectively. In an embodiment, the anode and the cathode are separated by the membrane and are both exposed to a reducing environment.

In an embodiment, the anode comprises doped or undoped ceria and a material selected from the group consisting of Cu, CuO, $Cu_2O$, Ag, $Ag_2O$, Au, $Au_2O$, $Au_2O_3$, Pt, Pd, Ru, Rh, Ir, LaCaCr, LaSrCrFe, YSZ, CGO, SDC, SSZ, LSGM, stainless steel, and combinations thereof; and wherein the cathode comprises Ni or NiO and a material selected from the group consisting of YSZ, 8YSZ, CGO, CoCGO, SDC, SSZ, LSGM, and combinations thereof. In an embodiment, the anode comprises lanthanum chromite and a material selected from the group consisting of doped ceria, yttria-stabilized zirconia (YSZ), lanthanum strontium gallate magnesite (LSGM), scandia-stabilized zirconia (SSZ), Sc and Ce doped zirconia, and combinations thereof; wherein the cathode comprises Ni or NiO and a material selected from the group consisting of YSZ, 8YSZ, CGO, CoCGO, SDC, SSZ, LSGM, and combinations thereof. In an embodiment, the lanthanum chromite comprises undoped lanthanum chromite, strontium doped lanthanum chromite, iron doped lanthanum chromite, strontium and iron doped lanthanum chromite, lanthanum calcium chromite, or combinations thereof.

In an embodiment, the reactor comprises no interconnect. In an embodiment, the reactor does not generate electricity and does not need electricity input for the reactor zones to operate. In an embodiment, the first stream has a temperature of no less than 700° C. or no less than 800° C. or no less than 900° C.

FIG. 1 illustrates an electrochemical reactor or an electrochemical (EC) gas producer 100, according to an embodiment of this disclosure. EC gas producer device 100 comprises first electrode 101, membrane 103 a second electrode 102. First electrode 101 (also referred to as anode or bi-functional layer) is configured to receive a fuel 104. Stream 104 contains no oxygen. Second electrode 102 is configured to receive water (e.g., steam) as denoted by 105.

In an embodiment, device 100 is configured to receive CO, i.e., carbon monoxide (104) and to generate $CO/CO_2$ (106) at the first electrode (101); device 100 is also configured to receive water or steam (105) and to generate hydrogen (107) at the second electrode (102). In some cases, the second electrode receives a mixture of steam and hydrogen. Since water provides the oxide ion (which is transported through the membrane) needed to oxidize the CO at the opposite electrode, water is considered the oxidant in this scenario. As such, the first electrode 101 is performing oxidation reactions in a reducing environment. In various embodiments, 103 represents an oxide ion conducting membrane. In an embodiment, the first electrode 101 and the second electrode 102 comprise Ni—YSZ or NiO—YSZ. In an embodiment, the oxide ion conducting membrane 103 also conducts electrons. In these cases, gases containing $H_2$, CO, syngas, or combinations thereof are suitable as feed stream 104. In various embodiments, electrodes 101 and 102 comprise Ni or NiO and a material selected from the group consisting of YSZ, 8YSZ, CGO, CoCGO, SDC, SSZ, LSGM, and combinations thereof. Alternatively, gases containing a hydrocarbon are reformed before coming into contact with the membrane 103/electrode 101. The reformer is configured to perform steam reforming, dry reforming, or combination thereof. The reformed gases are suitable as feed stream 104.

In an embodiment, device 100 is configured to simultaneously produce hydrogen 107 from the second electrode 102 and syngas 106 from the first electrode 101. In an embodiment, 104 represents methane and water or methane and carbon dioxide entering device 100. In another embodiment, 104 represents methane. In other embodiments, 103 represents an oxide ion conducting membrane. Arrow 104 represents an influx of hydrocarbon and water or hydrocarbon and carbon dioxide. Arrow 105 represents an influx of water or water and hydrogen. In some embodiments, electrode 101 comprises Cu-CGO, or further optionally comprises CuO or $Cu_2O$ or combination thereof; electrode 102 comprises Ni—YSZ or NiO—YSZ. In some cases, electrode 101 comprises doped or undoped ceria and a material selected from the group consisting of Cu, CuO, $Cu_2O$, Ag, $Ag_2O$, Au, $Au_2O$, $Au_2O_3$, Pt, Pd, Ru, Rh, Ir, LaCaCr, LaSrCrFe, YSZ, CGO, SDC, SSZ, LSGM, stainless steel, and combinations thereof; and electrode 102 comprises Ni or NiO and a material selected from the group consisting of YSZ, 8YSZ, CGO, CoCGO, SDC, SSZ, LSGM, and combinations thereof. In some cases, electrode 101 comprises lanthanum chromite and a material selected from the group consisting of doped ceria, yttria-stabilized zirconia (YSZ), lanthanum strontium gallate magnesite (LSGM), scandia-stabilized zirconia (SSZ), Sc and Ce doped zirconia, and combinations thereof electrode 102 comprises Ni or NiO and a material selected from the group consisting of YSZ, 8YSZ, CGO, CoCGO, SDC, SSZ, LSGM, and combinations thereof. In various embodiments, the lanthanum chromite comprises undoped lanthanum chromite, strontium doped lanthanum chromite, iron doped lanthanum chromite, strontium and iron doped lanthanum chromite, lanthanum calcium chromite, or combinations thereof.

Arrow 104 represents an influx of hydrocarbon with little to no water, with no carbon dioxide, and with no oxygen, and 105 represents an influx of water or water and hydrogen. Since water provides the oxide ion (which is transported through the membrane) needed to oxidize the hydrocarbon/fuel at the opposite electrode, water is considered the oxidant in this scenario. In these cases, gases containing a hydrocarbon are suitable as feed stream 104 and reforming of the gases is not necessary. In these cases, electrochemical reforming is enabled by the reactor, where the oxygen needed to reform the methane derives from the reduction of water, and it is supplied across the membrane. The half-cell reactions are electrochemical and are as follows:

$$CH_4+O_2 \rightleftharpoons CO+2H_2+2e^- \quad \text{(at the anode)}$$

$$H_2O+2e^- \rightleftharpoons H_2+O^{2-} \quad \text{(at the cathode)}$$

In this disclosure, no oxygen means there is no oxygen present at first electrode 101 or at least not enough oxygen that would interfere with the reaction. Also, in this disclosure, water only means that the intended feedstock is water and does not exclude trace elements or inherent components in water. For example, water containing salts or ions is considered to be within the scope of water only. Water only also does not require 100% pure water but includes this embodiment. In embodiments, the hydrogen produced from second electrode 102 is pure hydrogen, which means that in the produced gas phase from the second electrode, hydrogen is the main component. In some cases, the hydrogen content is no less than 99.5%. In some cases, the hydrogen content is no less than 99.9%. In some cases, the hydrogen produced from the second electrode is the same purity as that produced from electrolysis of water.

In an embodiment, first electrode 101 is configured to receive methane or methane and water or methane and carbon dioxide. In an embodiment, the fuel comprises a hydrocarbon having a carbon number in the range of 1-12, 1-10 or 1-8. Most preferably, the fuel is methane or natural gas, which is predominantly methane. In an embodiment, the device does not generate electricity and is not a fuel cell.

In various embodiments, the device does not contain a current collector. In an embodiment, the device comprises no interconnect. There is no need for electricity and such a device is not an electrolyzer. This is a major advantage of the EC reactor of this disclosure. The membrane 103 is configured to conduct electrons and as such is mixed conducting, i.e., both electronically conductive and ionically conductive. In an embodiment, the membrane 103 conducts oxide ions and electrons. In an embodiment, the electrodes 101, 102 and the membrane 103 are tubular (see, e.g., FIGS. 2A and 2B). In an embodiment, the electrodes 101, 102 and the membrane 103 are planar. In these embodiments, the electrochemical reactions at the anode and the cathode are spontaneous without the need to apply potential/electricity to the reactor.

In an embodiment, the electrochemical reactor (or EC gas producer) is a device comprising a first electrode, a second electrode, and a membrane between the electrodes, wherein the first electrode and the second electrode comprise a metallic phase that does not contain a platinum group metal when the device is in use, and wherein the membrane is oxide ion conducting. In an embodiment, the first electrode is configured to receive a fuel. In an embodiment, said fuel comprises a hydrocarbon or hydrogen or carbon monoxide or combinations thereof. In an embodiment, the second electrode is configured to receive water and hydrogen and configured to reduce the water to hydrogen. In various embodiments, such reduction takes place electrochemically.

In an embodiment, the membrane comprises an electronically conducting phase containing doped lanthanum chromite or an electronically conductive metal or combination thereof; and wherein the membrane comprises an ionically conducting phase containing a material selected from the group consisting of gadolinium doped ceria (CGO), samarium doped ceria (SDC), yttria-stabilized zirconia (YSZ), lanthanum strontium gallate magnesite (LSGM), scandia-stabilized zirconia (SSZ), Sc and Ce doped zirconia, and combinations thereof. In an embodiment, the doped lanthanum chromite comprises strontium doped lanthanum chromite, iron doped lanthanum chromite, strontium and iron doped lanthanum chromite, lanthanum calcium chromite, or combinations thereof; and wherein the conductive metal comprises Ni, Cu, Ag, Au, Pt, Rh, Co, Ru, or combinations thereof.

Figure 2A:
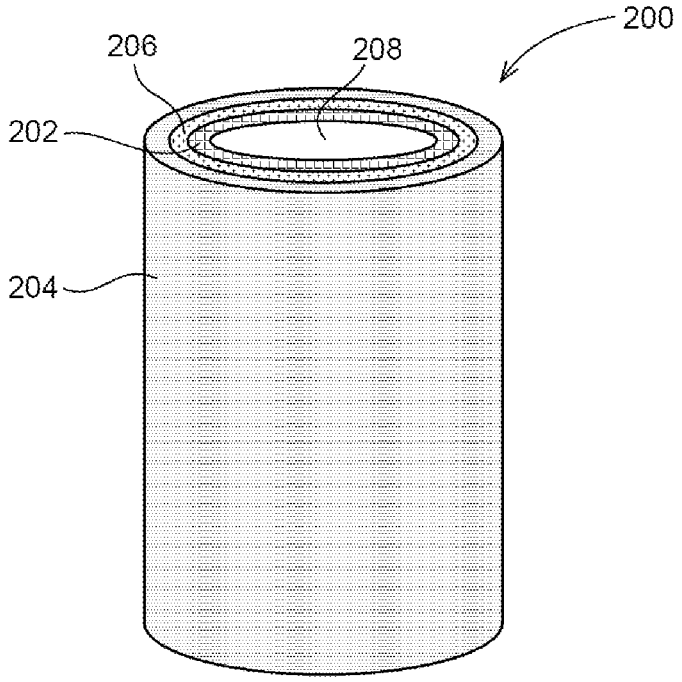
FIG. 2A illustrates a tubular electrochemical reactor, according to an embodiment of this disclosure.
Figure 2B:
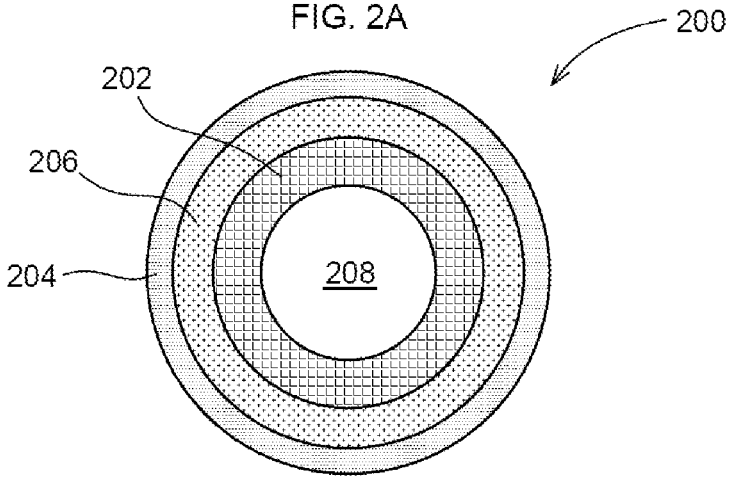
FIG. 2B illustrates a cross section of a tubular electrochemical reactor, according to an embodiment of this disclosure.

FIG. 2A illustrates (not to scale) a tubular electrochemical (EC) reactor or an EC gas producer 200, according to an embodiment of this disclosure. Tubular producer 200 includes an inner tubular structure 202, an outer tubular structure 204, and a membrane 206 disposed between the inner and outer tubular structures 202, 204, respectively. Tubular producer 200 further includes a void space 208 for fluid passage. FIG. 2B illustrates (not to scale) a cross section of a tubular producer 200, according to an embodiment of this disclosure. Tubular producer 200 includes a first inner tubular structure 202, a second outer tubular structure 204, and a membrane 206 between the inner and outer tubular structures 202, 204. Tubular producer 200 further includes a void space 208 for fluid passage.

In an embodiment, the electrodes and the membrane are tubular with the first electrode being outermost and the second electrode being innermost, wherein the second electrode is configured to receive water and hydrogen. In an embodiment, the electrodes and the membrane are tubular with the first electrode being innermost and the second electrode being outermost, wherein the second electrode is configured to receive water and hydrogen. In an embodiment, the electrodes and the membrane are tubular.

In an embodiment, the reactor comprises a catalyst that promotes chemical reverse water gas shift (RWGS) reactions. In an embodiment, the catalyst is a high temperature RWGS catalyst. In an embodiment, the catalyst is part of an anode in the reactor. In an embodiment, the catalyst is configured to be outside of the anode. For example, Ni—$Al_2O_3$ pellets as such a catalyst are placed in the reactor surrounding the tubes as shown in FIG. 2A and FIG. 2B. In an embodiment, the catalyst comprises Ni, Cu, Fe, Pt-group metals, or combinations thereof. In an embodiment, the catalyst comprises Pt, Cu, Rh, Ru, Fe, Ni, or combinations thereof.

Herein discussed is a method of producing hydrogen comprising providing an electrochemical (EC) reactor having a mixed-conducting membrane, introducing a first stream comprising a fuel to the reactor, introducing a second stream comprising water to the reactor, reducing the water in the second stream to produce hydrogen, and recycling at least portion of the produced hydrogen to the first stream, wherein the first stream and the second stream do not come in contact with each other in the reactor.

In an embodiment, the reduction from water to hydrogen takes place electrochemically. In an embodiment, water in the second stream is steam. In an embodiment, the first stream and the second stream are separated by the membrane. In an embodiment, the second stream comprises hydrogen and wherein optionally the first stream comprises water, carbon dioxide, an inert gas, or combinations thereof. In an embodiment, the fuel comprises a hydrocarbon, carbon monoxide, hydrogen, or combinations thereof. In an embodiment, the first stream consists essentially of a hydrocarbon and recycled hydrogen.

In an embodiment, the EC reactor comprises an anode on the first stream side and a cathode on the second stream side, wherein the anode and the cathode are separated by the membrane and are in contact with the membrane respectively. In an embodiment, the anode and the cathode are separated by the membrane and are both exposed to a reducing environment. In an embodiment, the anode and the cathode comprise Ni or NiO and a material selected from the group consisting of YSZ, 8YSZ, CGO, CoCGO, SDC, SSZ, LSGM, and combinations thereof. In an embodiment, the anode comprises doped or undoped ceria and a material selected from the group consisting of Cu, CuO, $Cu_2O$, Ag, $Ag_2O$, Au, $Au_2O$, $Au_2O_3$, Pt, Pd, Ru, Rh, Ir, LaCaCr, LaSrCrFe, YSZ, CGO, SDC, SSZ, LSGM, stainless steel, and combinations thereof; and wherein the cathode comprises Ni or NiO and a material selected from the group consisting of YSZ, 8YSZ, CGO, CoCGO, SDC, SSZ, LSGM, and combinations thereof.

In an embodiment, the anode comprises lanthanum chromite and a material selected from the group consisting of doped ceria, yttria-stabilized zirconia (YSZ), lanthanum strontium gallate magnesite (LSGM), scandia-stabilized zirconia (SSZ), Sc and Ce doped zirconia, and combinations thereof; wherein the cathode comprises Ni or NiO and a material selected from the group consisting of YSZ, 8YSZ, CGO, CoCGO, SDC, SSZ, LSGM, and combinations thereof; and wherein optionally the lanthanum chromite comprises undoped lanthanum chromite, strontium doped lanthanum chromite, iron doped lanthanum chromite, strontium and iron doped lanthanum chromite, lanthanum calcium chromite, or combinations thereof.

In an embodiment, at least a portion of the anode exhaust gas is used to produce steam from water. In an embodiment, at least a portion of the anode exhaust gas is sent to a carbon capture unit. In an embodiment, the method comprises recycling at least portion of the produced hydrogen to the second stream.

In an embodiment, the membrane comprises an electronically conducting phase containing doped lanthanum chromite or an electronically conductive metal or combination thereof and wherein the membrane comprises an ionically conducting phase containing a material selected from the group consisting of gadolinium doped ceria (CGO), samarium doped ceria (SDC), yttria-stabilized zirconia (YSZ), lanthanum strontium gallate magnesite (LSGM), scandia-stabilized zirconia (SSZ), Sc and Ce doped zirconia, and combinations thereof. In an embodiment, the doped lanthanum chromite comprises strontium doped lanthanum chromite, iron doped lanthanum chromite, strontium and iron doped lanthanum chromite, lanthanum calcium chromite, or combinations thereof and wherein the conductive metal comprises Ni, Cu, Ag, Au, Pt, Rh, Co, Ru, or combinations thereof. In an embodiment, the membrane comprises gadolinium doped ceria (CGO), samarium doped ceria (SDC). In an embodiment, the membrane consists of gadolinium doped ceria (CGO), samarium doped ceria (SDC).

In an embodiment, the membrane comprises cobalt-CGO (CoCGO), i.e., cobalt doped CGO. In an embodiment, the membrane consists essentially of CoCGO. In an embodiment, the membrane consists of CoCGO. In an embodiment, the membrane comprises LST (lanthanum-doped strontium titanate)-YSZ or LST-SSZ or LST-SCZ (scandia-ceria-stabilized zirconia). In an embodiment, the membrane consists essentially of LST-YSZ or LST-SSZ or LST-SCZ. In an embodiment, the membrane consists of LST-YSZ or LST-SSZ or LST-SCZ. In this disclosure, LST-YSZ refers to a composite of LST and YSZ. In various embodiments, the LST phase and the YSZ phase percolate each other. In this disclosure, LST-SSZ refers to a composite of LST and SSZ. In various embodiments, the LST phase and the SSZ phase percolate each other. In this disclosure, LST-SCZ refers to a composite of LST and SCZ. In various embodiments, the LST phase and the SCZ phase percolate each other. YSZ, SSZ, and SCZ are types of stabilized zirconia's.

In an embodiment, the membrane is impermeable to fluid flow. In an embodiment, the membrane conducts protons or oxide ions. In an embodiment, the membrane also conducts electrons and wherein the reactor comprises no interconnect. In an embodiment, the reactor does not generate electricity and does not need electricity input for the reactor zones to operate. In an embodiment, the first stream has a temperature of no less than 700° C. or no less than 800° C. or no less than 900° C.

Hydrogen Production System and Method

Herein discussed is a hydrogen production system comprising a first reactor zone and a second reactor zone, wherein both reactor zones comprise an ionically conducting membrane, wherein the first zone is capable of reforming a hydrocarbon electrochemically and the second zone is capable of performing water gas shift reactions electrochemically, wherein the electrochemical reforming reactions involve the exchange of an ion through the membrane to oxidize the hydrocarbon and wherein electrochemical water gas shift reactions involve the exchange of an ion through the membrane and include forward water gas shift reactions, or reverse water gas shift reactions, or both.

In an embodiment, the electrochemical reforming reactions comprise electrochemical half-cell reactions, wherein the half-cell reactions are:

$$CH_4+O_2 \rightleftharpoons CO+2H_2+2e^- \quad a)$$

$$H_2O+2e^- \rightleftharpoons H_2+O^{2-} \quad b)$$

In an embodiment, the electrochemical water gas shift reactions comprise electrochemical half-cell reactions, wherein the half-cell reactions are:

$$CO_{(gas)}+O^2 \rightleftharpoons CO_{2(gas)}+2e^- \quad a)$$

$$H_2O_{(gas)}+2e^- \rightleftharpoons H_{2(gas)}+O^{2-} \quad b)$$

In an embodiment, the half-cell reactions take place at triple phase boundaries, wherein the triple phase boundaries are the intersections of pores with the electronically conducting phase and the ionically conducting phase.

In an embodiment, both reactor zones comprise porous electrodes that comprise metallic phase and ceramic phase, wherein the metallic phase is electronically conductive, and wherein the ceramic phase is ionically conductive. In an embodiment, the electrodes have no current collector attached. In an embodiment, the electrodes are separated by the membrane and are both exposed to a reducing environment.

In an embodiment, the electrodes in the second reactor zone comprise Ni or NiO and a material selected from the group consisting of YSZ, 8YSZ, CGO, CoCGO, SDC, SSZ, LSGM, and combinations thereof. In an embodiment, one of the electrodes in the first reactor zone comprises Ni or NiO and a material selected from the group consisting of YSZ, 8YSZ, CGO, CoCGO, SDC, SSZ, LSGM, and combinations thereof, and wherein the other of the electrodes comprises doped or undoped ceria and a material selected from the group consisting of Cu, CuO, $Cu_2O$, Ag, $Ag_2O$, Au, $Au_2O$, $Au_2O_3$, Pt, Pd, Ru, Rh, Ir, LaCaCr, LaSrCrFe, YSZ, CGO, SDC, SSZ, LSGM, stainless steel, and combinations thereof. In an embodiment, one of the electrodes in the first reactor zone comprises Ni or NiO and a material selected from the group consisting of YSZ, 8YSZ, CGO, CoCGO, SDC, SSZ, LSGM, and combinations thereof, and wherein the other of the electrodes comprises lanthanum chromite and a material selected from the group consisting of doped ceria, yttria-stabilized zirconia (YSZ), lanthanum strontium gallate magnesite (LSGM), scandia-stabilized zirconia (SSZ), Sc and Ce doped zirconia, and combinations thereof. In an embodiment, the lanthanum chromite comprises undoped lanthanum chromite, strontium doped lanthanum chromite, iron doped lanthanum chromite, strontium and iron doped lanthanum chromite, lanthanum calcium chromite, or combinations thereof.

In an embodiment, the ionically conducting membrane conducts protons or oxide ions. In an embodiment, the ionically conducting membrane is impermeable to fluid flow. In an embodiment, the membrane comprises an electronically conducting phase containing doped lanthanum chromite or an electronically conductive metal or combination thereof; and wherein the membrane comprises an ionically conducting phase containing a material selected from the group consisting of gadolinium doped ceria (CGO), samarium doped ceria (SDC), yttria-stabilized zirconia (YSZ), lanthanum strontium gallate magnesite (LSGM), scandia-stabilized zirconia (SSZ), Sc and Ce doped zirconia, and combinations thereof. In an embodiment, the doped lanthanum chromite comprises strontium doped lanthanum chromite, iron doped lanthanum chromite, strontium and iron doped lanthanum chromite, lanthanum calcium chromite, or combinations thereof and wherein the conductive metal comprises Ni, Cu, Ag, Au, Pt, Rh, Co, Ru, or combinations thereof. In an embodiment, the membrane comprises gadolinium doped ceria (CGO) or samarium doped ceria (SDC) or both. In an embodiment, the membrane consists of gadolinium doped ceria (CGO) or samarium doped ceria (SDC) or both.

In an embodiment, the ionically conducting membrane also conducts electrons and wherein the system comprises no interconnect. In an embodiment, the first reactor zone and the second reactor zone are in fluid communication on two sides of the membrane respectively but not across the membrane. In an embodiment, the hydrocarbon passes through the first reactor zone prior to passing through the second reactor zone.

In an embodiment, the first reactor zone and the second reactor zone are on a single reactor tube. In an embodiment, the first reactor zone and the second reactor zone are on the same reactor tube or tubes. In an embodiment, the reactor tube has an open end and an opposite closed end. In an embodiment, the first reactor zone and the second reactor zone are on different reactor tubes. In an embodiment, the first reactor zone or the second reactor zone comprises multiple reactor tubes.

Also discussed herein is a method of producing hydrogen comprising providing a hydrogen production system comprising a first reactor zone and a second reactor zone, wherein both reactor zones comprise a mixed-conducting membrane, introducing a first stream comprising a hydrocarbon to the system, introducing a second stream comprising water to the system, and reducing the water in the second stream to produce hydrogen, wherein the first stream and the second stream do not come in contact with each other in the system, and wherein the hydrocarbon is reformed electrochemically in the first reactor zone.

In an embodiment, electrochemical water gas shift reactions take place in the second reactor zone. In an embodiment, reduction from water to hydrogen takes place electrochemically. In an embodiment, the first stream and the second stream are separated by the membrane. In an embodiment, the second stream comprises hydrogen. In an embodiment, the first stream consists essentially of a hydrocarbon and hydrogen. In an embodiment, both reactor zones comprise an anode on the first stream side and a cathode on the second stream side, wherein the anode and the cathode are separated by the membrane and are in contact with the membrane respectively. In an embodiment, the anode and the cathode are both exposed to a reducing environment.

In an embodiment, the anode and the cathode in the second reactor zone comprise Ni or NiO and a material selected from the group consisting of YSZ, 8YSZ, CGO, CoCGO, SDC, SSZ, LSGM, and combinations thereof. In an embodiment, the anode in the first reactor zone comprises doped or undoped ceria and a material selected from the group consisting of Cu, CuO, $Cu_2O$, Ag, $Ag_2O$, Au, $Au_2O$, $Au_2O_3$, Pt, Pd, Ru, Rh, Ir, LaCaCr, LaSrCrFe, YSZ, CGO, SDC, SSZ, LSGM, stainless steel, and combinations thereof; and wherein the cathode in the first reactor zone comprises Ni or NiO and a material selected from the group consisting of YSZ, 8YSZ, CGO, CoCGO, SDC, SSZ, LSGM, and combinations thereof. In an embodiment, the anode in the first reactor zone comprises lanthanum chromite and a material selected from the group consisting of doped ceria, yttria-stabilized zirconia (YSZ), lanthanum strontium gallate magnesite (LSGM), scandia-stabilized zirconia (SSZ), Sc and Ce doped zirconia, and combinations thereof; wherein the cathode in the first reactor zone comprises Ni or NiO and a material selected from the group consisting of YSZ, 8YSZ, CGO, CoCGO, SDC, SSZ, LSGM, and combinations thereof. In an embodiment, the lanthanum chromite comprises undoped lanthanum chromite, strontium doped lanthanum chromite, iron doped lanthanum chromite, strontium and iron doped lanthanum chromite, lanthanum calcium chromite, or combinations thereof.

In an embodiment, the method comprises recycling at least portion of the produced hydrogen to the first stream or the second stream or both. In an embodiment, the system comprises no interconnect. In an embodiment, the system does not generate electricity and does not need electricity input for the reactor zones to operate. In an embodiment, the first stream passes through the first reactor zone prior to passing through the second reactor zone.

In an embodiment, the first reactor zone and the second reactor zone are on a single reactor tube. In an embodiment, the first reactor zone and the second reactor zone are on the same reactor tube or tubes. In an embodiment, the reactor tube has an open end and an opposite closed end. In an embodiment, the first reactor zone or the second reactor zone comprises multiple reactor tubes. In an embodiment, the reactor tubes each have an open end and an opposite closed end. In an embodiment, the first reactor zone and the second reactor zone are on different reactor tubes.

In an embodiment, the first stream enters the system at a temperature no less than 700° C., or no less than 750° C., or no less than 800° C., or no less than 850° C., or no less than 900° C. In an embodiment, the system is operated at a temperature no less than 500° C., or no less than 600° C., or no less than 700° C., or no less than 750° C., or no less than 800° C., or no less than 850° C., or no less than 900° C., or no less than 950° C., or no less than 1000° C. In various embodiment, the pressure differential between the electrodes is no greater than 2 psi, or no greater than 1.5 psi, or no greater than 1 psi. In an embodiment, the first stream enters the system at a pressure of no greater than 10 psi, or no greater than 5 psi, or no greater than 3 psi. In an embodiment, the second stream enters the device at a pressure of no greater than 10 psi, or no greater than 5 psi, or no greater than 3 psi.

In an embodiment, the second stream consists of water and hydrogen. In this disclosure, no significant amount of hydrogen or hydrocarbon or water means that the volume content of the hydrogen or hydrocarbon or water is no greater than 5%, or no greater than 3%, or no greater than 2%, or no greater than 1%, or no greater than 0.5%, or no greater than 0.1%, or no greater than 0.05%. In an embodiment, the first stream comprises CO or $H_2$ or both. In an embodiment, the first stream comprises inert gases like argon or nitrogen. In an embodiment, the second stream consists of water and hydrogen.

In an embodiment, the method comprises using the extracted hydrogen in one of Fischer-Tropsch (FT) reactions, dry reforming reactions, Sabatier reaction catalyzed by nickel, Bosch reaction, reverse water gas shift reaction, electrochemical reaction to produce electricity, production of ammonia, production of fertilizer, electrochemical compressor for hydrogen storage, fueling hydrogen vehicles or hydrogenation reactions or combinations thereof.

Figure 3A:
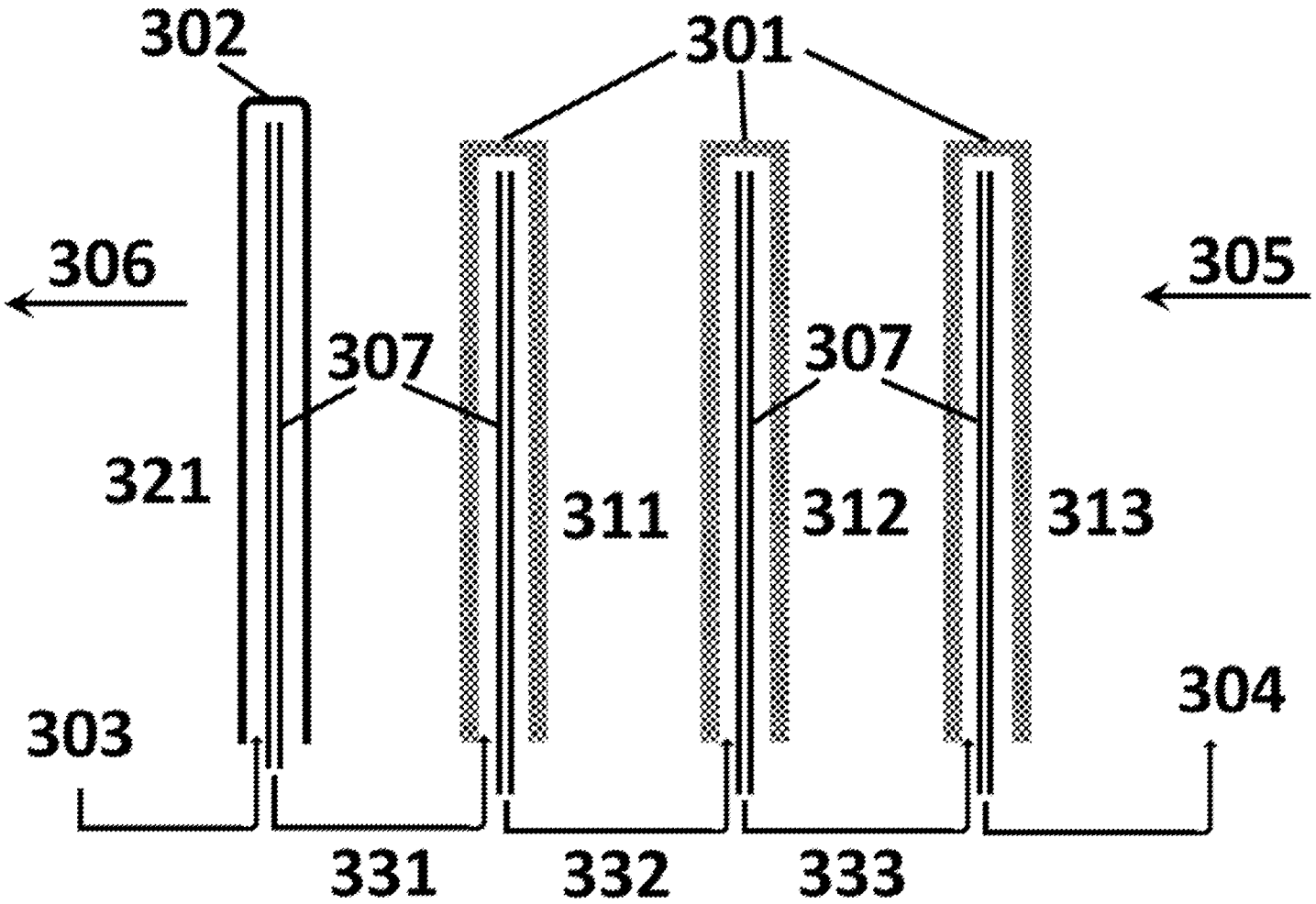
FIGS. 3A and 3B illustrate hydrogen production systems as discussed herein, according to various embodiments of this disclosure.

As illustrated in FIG. 3A, a hydrogen production system is shown. In FIG. 3A, 302 represents the first reactor zone comprising a reactor tube 321 having an open end and an opposite closed end. 301 represents the second reactor zone comprising multiple reactor tubes 311, 312, and 313 each having an open end and an opposite closed end. 307 represents inlet or outlet extending toward the closed end of each reactor tube. The inner surface of the reactor tubes comprises the anodes for the first reactor zone and the second reactor zone. The outer surface of the reactor tubes comprises the cathodes for the first reactor zone and the second reactor zone. Each reactor tube has a mixed-conducting membrane that is gas-tight or impermeable to fluid flow. (For example, the membrane conducts both oxide ions and electrons.) The membrane separates the inner surface and the outer surface of the reactor tubes. A first stream 303 comprising a hydrocarbon is fed into the annulus of the reactor tube 321. The anode exhaust from tube 321 is extracted from outlet 307 as stream 331 and introduced into the annulus of the next reactor tube 311. Stream 331 comprises CO, $H_2$, $CO_2$, $H_2O$, and unreacted feed components, which is suitable fuel for the reactor tubes in the second reactor zone. Anode exhaust 332 from tube 311 is extracted and fed into the annulus of reactor tube 312. Anode exhaust 333 from tube 312 is extracted and fed into the annulus of reactor tube 313. Anode exhaust 304 is extracted from tube 313 via outlet 307. A second stream 305 comprising water or steam is passed on the outside of the reactor tubes as shown in FIG. 3A. Stream 305 may also comprise hydrogen. Water is reduced electrochemically to produce hydrogen. Stream 306 (cathode exhaust) comprises steam and hydrogen. The first stream and the second stream are separated by the membrane and do not come in contact with one another. The anode exhaust and the cathode exhaust are also separated by the membrane and do not come in contact with one another.

Figure 3B:
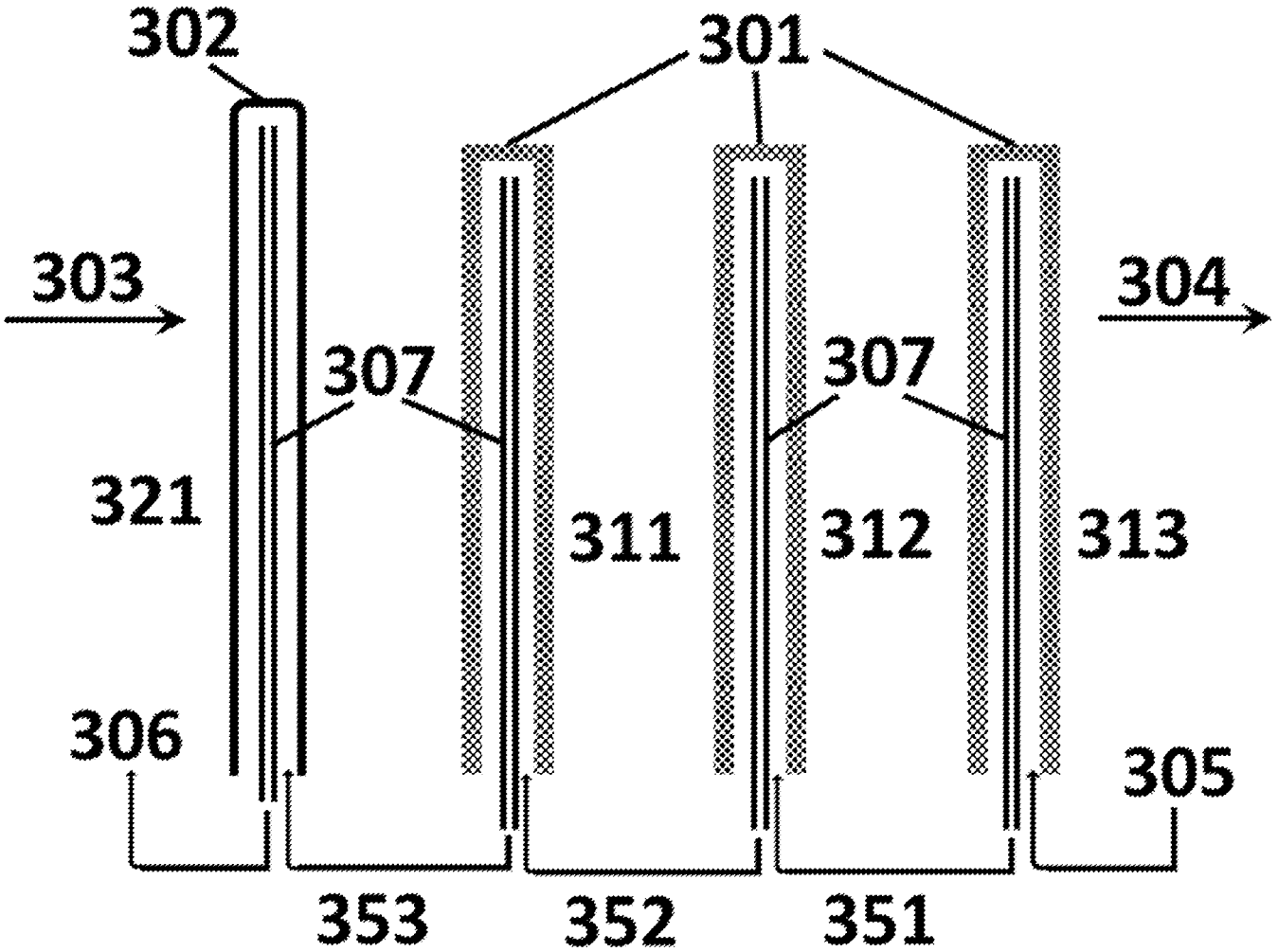

As illustrated in FIG. 3B, an alternative hydrogen production system is shown. In this case, the inner surface of the reactor tubes (321, 311, 312, 313) comprises the cathodes for the first reactor zone 302 and the second reactor zone 301. The outer surface of the reactor tubes (321, 311, 312, 313) comprises the anodes for the first reactor zone 302 and the second reactor zone 301. A first stream 303 comprising a hydrocarbon is passed on the outside of the reactor tubes. Anode exhaust 304 is extracted. The hydrocarbon in stream 303 is reformed electrochemically via reactor tube 321 in the first reactor zone 302 and becomes suitable fuel for reactor tubes 311, 312, and 313 in the second reactor zone 301. A second stream 305 comprising water/steam is introduced into the annulus of reactor tube 313. Cathode exhaust 351 comprising steam and hydrogen is extracted from tube 313 through outlet 307 and fed into the annulus of tube 312. Cathode exhaust 352 comprising steam and hydrogen is extracted from tube 312 through outlet 307 and fed into the annulus of tube 311. Cathode exhaust 353 comprising steam and hydrogen is extracted from tube 311 through outlet 307 and fed into the annulus of tube 321. Stream 306 as cathode exhaust is extracted from tube 321 via outlet 307 as a product stream comprising water/steam and hydrogen. The first stream and the second stream are separated by the membrane and do not come in contact with one another. The anode exhaust and the cathode exhaust are also separated by the membrane and do not come in contact with one another.

Figure 4A:
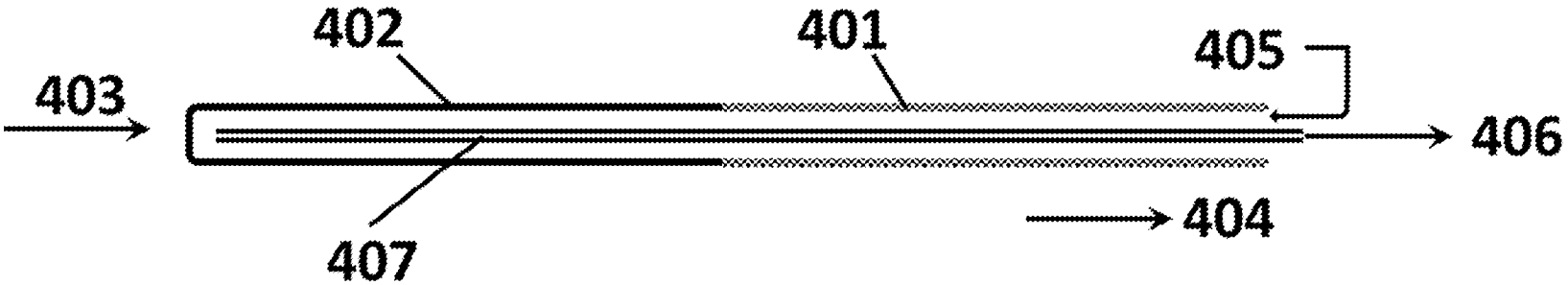
FIGS. 4A and 4B illustrate alternative hydrogen production systems as discussed herein, according to various embodiments of this disclosure.

As illustrated in FIG. 4A, another hydrogen production system is shown. 402 represents the first reactor zone and 401 represents the second reactor zone, which zones are on a single reactor tube. The reactor tube has an open end and an opposite closed end. 407 represents inlet/outlet extending toward the closed end of the reactor tube. The inner surface of the reactor tube comprises the cathodes for the first reactor zone and the second reactor zone. The outer surface of the reactor tube comprises the anodes for the first reactor zone and the second reactor zone. Each reactor tube has a mixed-conducting membrane that is gas-tight or impermeable to fluid flow. (For example, the membrane conducts both oxide ions and electrons.) The membrane separates the inner surface and the outer surface of the reactor tube. A first stream 403 comprising a hydrocarbon is passed on the outside of the reactor tube, being reformed electrochemically by the first reactor zone 402 and converted to a suitable fuel for the second reactor zone 401. Anode exhaust 404 is extracted from the second reactor zone. A second stream 405 comprising water or steam is introduced into the annulus of the reactor tube. In some cases, stream 405 comprises hydrogen. Cathode exhaust 406 comprising steam and hydrogen is extracted via outlet 407. The first stream and the second stream are separated by the membrane and do not come in contact with one another. The anode exhaust and the cathode exhaust are also separated by the membrane and do not come in contact with one another.

Figure 4B:
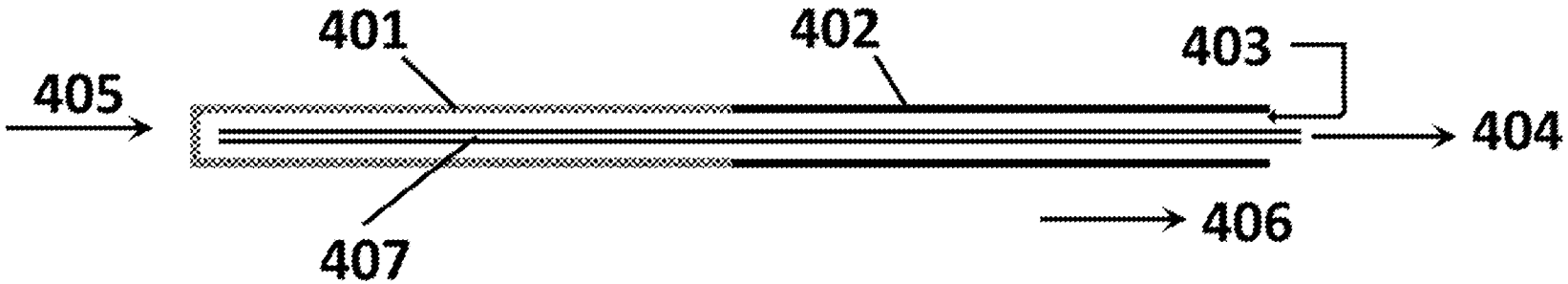

As illustrated in FIG. 4B, a hydrogen production system is shown. 402 represents the first reactor zone and 401 represents the second reactor zone, which zones are on a single reactor tube. The reactor tube has an open end and an opposite closed end. 407 represents inlet/outlet extending toward the closed end of the reactor tube. The inner surface of the reactor tube comprises the anodes for the first reactor zone and the second reactor zone. The outer surface of the reactor tube comprises the cathodes for the first reactor zone and the second reactor zone. Each reactor tube has a mixed-conducting membrane that is gas-tight or impermeable to fluid flow. The membrane separates the inner surface and the outer surface of the reactor tube. A first stream 403 comprising a hydrocarbon is introduced into the annulus of the reactor tube, being reformed electrochemically by the first reactor zone 402 and converted to a suitable fuel for the second reactor zone 401. Anode exhaust 404 is extracted from the second reactor zone 401 via outlet 407. A second stream 405 comprising water or steam is passed on the outside of the reactor tube. In some cases, stream 405 comprises hydrogen. Cathode exhaust 406 comprising steam and hydrogen is extracted. The first stream and the second stream are separated by the membrane and do not come in contact with one another. The anode exhaust and the cathode exhaust are also separated by the membrane and do not come in contact with one another.

It is to be understood that this disclosure describes exemplary embodiments for implementing different features, structures, or functions of the invention. Exemplary embodiments of components, arrangements, and configurations are described to simplify the present disclosure; however, these exemplary embodiments are provided merely as examples and are not intended to limit the scope of the invention. The embodiments as presented herein may be combined unless otherwise specified. Such combinations do not depart from the scope of the disclosure.

Additionally, certain terms are used throughout the description and claims to refer to particular components or steps. As one skilled in the art appreciates, various entities may refer to the same component or process step by different names, and as such, the naming convention for the elements described herein is not intended to limit the scope of the invention. Further, the terms and naming convention used herein are not intended to distinguish between components, features, and/or steps that differ in name but not in function.

While the disclosure is susceptible to various modifications and alternative forms, specific embodiments thereof are shown by way of example in the drawings and description. It should be understood, however, that the drawings and detailed description are not intended to limit the disclosure to the particular form disclosed, but on the contrary, the intention is to cover all modifications, equivalents and alternatives falling within the spirit and scope of this disclosure.

What is claimed is:

1. A hydrogen production system comprising a first reactor zone and a second reactor zone, wherein both reactor zones comprise a mixed con ducting membrane, wherein the membrane comprises CoCGO (cobalt-gadolinium-doped ceria)- or LST (lanthanum-doped strontium titanate)-stabilized zirconia or alternatively the membrane comprises an electronically conducting phase containing doped lanthanum chromite or an electronically conductive metal or combination thereof, and wherein the membrane comprises an ionically conducting phase containing a material selected from the group consisting of gadolinium doped ceria (CGO), samarium doped ceria (SDC), yttria-stabilized zirconia (YSZ), lanthanum strontium gallate magnesite (LSGM), scandia-stabilized zirconia (SSZ), Sc and Ce doped zirconia, and combinations thereof, wherein the first zone is capable of reforming a hydrocarbon electrochemically and the second zone is capable of performing water gas shift reactions electrochemically, wherein the electrochemical reforming reactions involve the exchange of an ion through the membrane to oxidize the hydrocarbon, wherein the electrochemical water gas shift reactions involve the exchange of an ion through the membrane and include forward water gas shift reactions, or reverse water gas shift reactions, or both, and wherein the first reactor zone and the second reactor zone are in fluid communication on two sides of the membrane respectively but not across the membrane.

2. The system of claim 1, wherein the electrochemical reforming reactions comprise electrochemical half-cell reactions, wherein the half-cell reactions are:

$$CH_4+O^{2-} \rightleftharpoons CO+2H_2+2e^- \quad \text{a.}$$

$$H_2O+2e^- \rightleftharpoons H_2+O^{2-}. \quad \text{b.}$$

3. The system of claim 1, wherein the electrochemical water gas shift reactions comprise electrochemical half-cell reactions, wherein the half-cell reactions are:

$$CO_{(gas)}+O^{2-} \rightleftharpoons CO_{2(gas)}+2e^- \quad \text{a.}$$

$$H_2O_{(gas)}+2e^- \rightleftharpoons H_{2(gas)}+O^{2-}. \quad \text{b.}$$

4. The system of claim 1, wherein both reactor zones comprise porous electrodes that comprise metallic phase and ceramic phase, wherein the metallic phase is electronically conductive, and wherein the ceramic phase is ionically conductive.

5. The system of claim 4, wherein the electrodes in the second reactor zone comprise Ni or NiO and a material selected from the group consisting of YSZ, 8YSZ, CGO, CoCGO, SDC, SSZ, LSGM, and combinations thereof.

6. The system of claim 4, wherein one of the electrodes in the first reactor zone comprises Ni or NiO and a material selected from the group consisting of YSZ, 8YSZ, CGO, CoCGO, SDC, SSZ, LSGM, and combinations thereof, and wherein the other of the electrodes in the first reactor zone comprises doped or undoped ceria and a material selected from the group consisting of Cu, CuO, $Cu_2O$, Ag, $Ag_2O$, Au, $Au_2O$, $Au_2O_3$, Pt, Pd, Ru, Rh, Ir, LaCaCr, LaSrCrFe, YSZ, CGO, SDC, SSZ, LSGM, stainless steel, and combinations thereof.

7. The system of claim 4, wherein one of the electrodes in the first reactor zone comprises Ni or NiO and a material selected from the group consisting of YSZ, 8YSZ, CGO, CoCGO, SDC, SSZ, LSGM, and combinations thereof, and wherein the other of the electrodes in the first reactor zone comprises lanthanum chromite and a material selected from the group consisting of doped ceria, yttria-stabilized zirconia (YSZ), lanthanum strontium gallate magnesite (LSGM), scandia-stabilized zirconia (SSZ), Sc and Ce doped zirconia, and combinations thereof.

8. The system of claim 1, wherein the stabilized zirconia comprises YSZ or SSZ or SCZ (scandia-ceria-stabilized zirconia).

9. The system of claim 1, wherein the ionically conducting membrane also conducts electrons and wherein the system comprises no interconnect.

10. The system of claim 1, wherein the hydrocarbon passes through the first reactor zone prior to passing through the second reactor zone.

11. The system of claim 1, wherein the first reactor zone or the second reactor zone comprises multiple reactor tubes.

12. The system of claim 1, wherein the first reactor zone and the second reactor zone are on the same reactor tube or reactor tubes.

* * * * *